US006425926B1

(12) United States Patent
Hindriks et al.

(10) Patent No.: US 6,425,926 B1
(45) Date of Patent: Jul. 30, 2002

(54) THERMOSOL TREATMENT OF TEXTILES CARRYING A DYE

(76) Inventors: Jakobus Hindriks, Uithof 3, 7761 Xn Schoonebeek (NL); Peter Hollanders, St. Severustraat 26, 5616 NZ Eindhoven (NL); Andreas Thomas Dorsch, Ewaldstrasse 24, 44625 Herne (DE); Otto Arnout Richard Pennekamp, Ihmerterstrasse 228C, 58675 Hemer (DE)

( * ) Notice: Subject to any disclaimer, the term of this patent is extended or adjusted under 35 U.S.C. 154(b) by 0 days.

(21) Appl. No.: 09/305,173

(22) Filed: May 4, 1999

(51) Int. Cl.[7] ..... D06B 5/12

(52) U.S. Cl. ..... 8/149.2; 68/5 D; 68/5 E; 68/205 R

(58) Field of Search ..... 68/5 D, 5 E, 19.1, 68/20, 205 R; 8/149.2; 226/173

(56) References Cited

U.S. PATENT DOCUMENTS

| | | | | | |
|---|---|---|---|---|---|
| 1,037,370 | A | * | 9/1912 | Tompkins | 68/5 D |
| 2,008,230 | A | * | 7/1935 | Spooner | 68/5 D |
| 3,768,280 | A | * | 10/1973 | Kannegiesser et al. | |
| 3,881,229 | A | * | 5/1975 | Reid | |
| 3,895,909 | A | * | 7/1975 | Greer | 68/5 D |
| 3,973,417 | A | | 8/1976 | Greer | |
| 3,997,928 | A | * | 12/1976 | Leifeld | 68/5 D |
| 4,170,578 | A | * | 10/1979 | Schelhaas | |
| 4,541,340 | A | * | 9/1985 | Peart et al. | |
| 4,567,064 | A | * | 1/1986 | Woste | 68/205 R |
| 4,591,697 | A | * | 5/1986 | Lexer | |
| 4,718,257 | A | * | 1/1988 | Reinehr et al. | 68/5 D |
| 5,124,559 | A | * | 6/1992 | Zertani et al. | |
| 5,134,866 | A | * | 8/1992 | Enderlin | 68/5 D |

FOREIGN PATENT DOCUMENTS

| | | | | |
|---|---|---|---|---|
| FR | 1204584 | * | 1/1960 | 68/5 D |
| FR | 1554317 | * | 12/1968 | 68/5 D |
| FR | 1555271 | * | 12/1968 | 68/5 D |
| GB | 844320 | * | 8/1960 | 68/5 D |
| JP | 55-61493 | * | 5/1980 | 68/5 D |
| JP | 1-201570 | * | 8/1989 | 68/205 R |
| WO | WO 95/19266 | | 7/1995 | |

OTHER PUBLICATIONS

Production Document "Elstein IR2000", pp. marked 2 and 3, dated prior to May 4, 1999.

* cited by examiner

*Primary Examiner*—Frankie L. Stinson
(74) *Attorney, Agent, or Firm*—Pearne & Gordon LLP

(57) ABSTRACT

For thermosol treatment of surface printed textile, a printed textile is transported through a treatment space in its longitudinal direction. A heat source is arranged for emitting heat in the treatment space. A pressure drop is generated over the web in the treatment space from a first side of the web to an opposite, second side of the web for entraining sublimated ink on the first side of the web back to the web.

27 Claims, 2 Drawing Sheets

THERMOSOL TREATMENT OF TEXTILES CARRYING A DYE

FIELD OF THE INVENTION

The present invention relates to an apparatus and a method for thermosoling a dye carried by a textile material.

BACKGROUND ART

In thermosol (also known as thermofixation or thermosol fixation) treatment of textiles, dyestuffs applied to the textile are heated for dispersal and penetration of the dyestuffs to permanently attach the dye to the fibers of the textiles. It is known to apply the required heat in several ways, such as by radiation and by using steam. The heat applied to the textile and the attached dyestuffs causes the dyestuffs to diffuse into the polymer of the textile so that the dyestuffs are thoroughly bonded to the fibers. An example of such a method is described in international patent application WO 95/19266.

In U.S. Pat. No. 3,973,417, it is disclosed to heat the dyestuffs using infrared radiation. A problem of this known method is that it is not very efficient in terms of the amount of dye required to achieve a given printing density. The percentage of unused dyes, i.e. dyestuffs that do not bond with the fibers and have to be removed before the textile can be used without staining under normal conditions is substantial.

For this reason, the treated textile is washed after having been subjected to a heat treatment. This washing step increases manufacturing costs and the washing water needs to or at least should preferably be cleaned before it can be drained to waste. Even if the water is cleaned, the use of excess dyestuff, the water necessary for washing and the energy consumed in the course of washing and drying cause substantial amounts of pollution.

Moreover, this known form of thermosol treatment is unsuitable for treating textiles carrying a surface printing consisting of only small amounts of dye, such as textiles on which patterns have been printed by using an ink jet printer, since that would generally result in unacceptably low final printing densities. For that reason thermofixation of surface printed patterns onto a textile material has thus far usually been carried out by printing onto a substrate and transferring the pattern onto the textile by pressing the printed face of the substrate against the textile and simultaneously applying heat. However, transfer printing is laborious and also entails the consumption of large amounts of substrate which has to be discarded.

SUMMARY OF THE INVENTION

It is an object of the invention to make the thermosoling treatment of printed textiles more efficient in terms of the amount of dye on the textile necessary to achieve given printing densities and to reduce the extent to which staining is caused, so that, at least in general, washing of the treated textile can be dispensed with.

According to the present invention, this object is achieved by providing an apparatus for thermosol treatment of surface printed textile, with a transport structure for transporting a web of surface printed textile through a treatment space in its longitudinal direction, and at least one heat source arranged for emitting heat in the treatment space, the apparatus being adapted for generating a pressure drop over the web from a first side of the web to an opposite, second side of the web for entraining sublimated ink on the first side of the web back to the web.

According to the present invention, this object is also achieved by including the following steps in a method for thermosol treatment of surface printed textiles: providing a web of surface printed textile carrying a surface print on a printed face thereof, the printed face facing to a first side of the web, transporting the web along a trajectory extending through a treatment space, heating at least a portion of the web in the treatment space and generating a pressure drop over the web from the first side of the web to an opposite, second side of the web for entraining sublimated ink on the first side of the web back to the web.

The foregoing and other objects, features and effects of the present invention are further described in and may be more readily understood from the following detailed description of exemplary embodiments in conjunction with the accompanying drawings.

DETAILED DESCRIPTION

Figure 1:
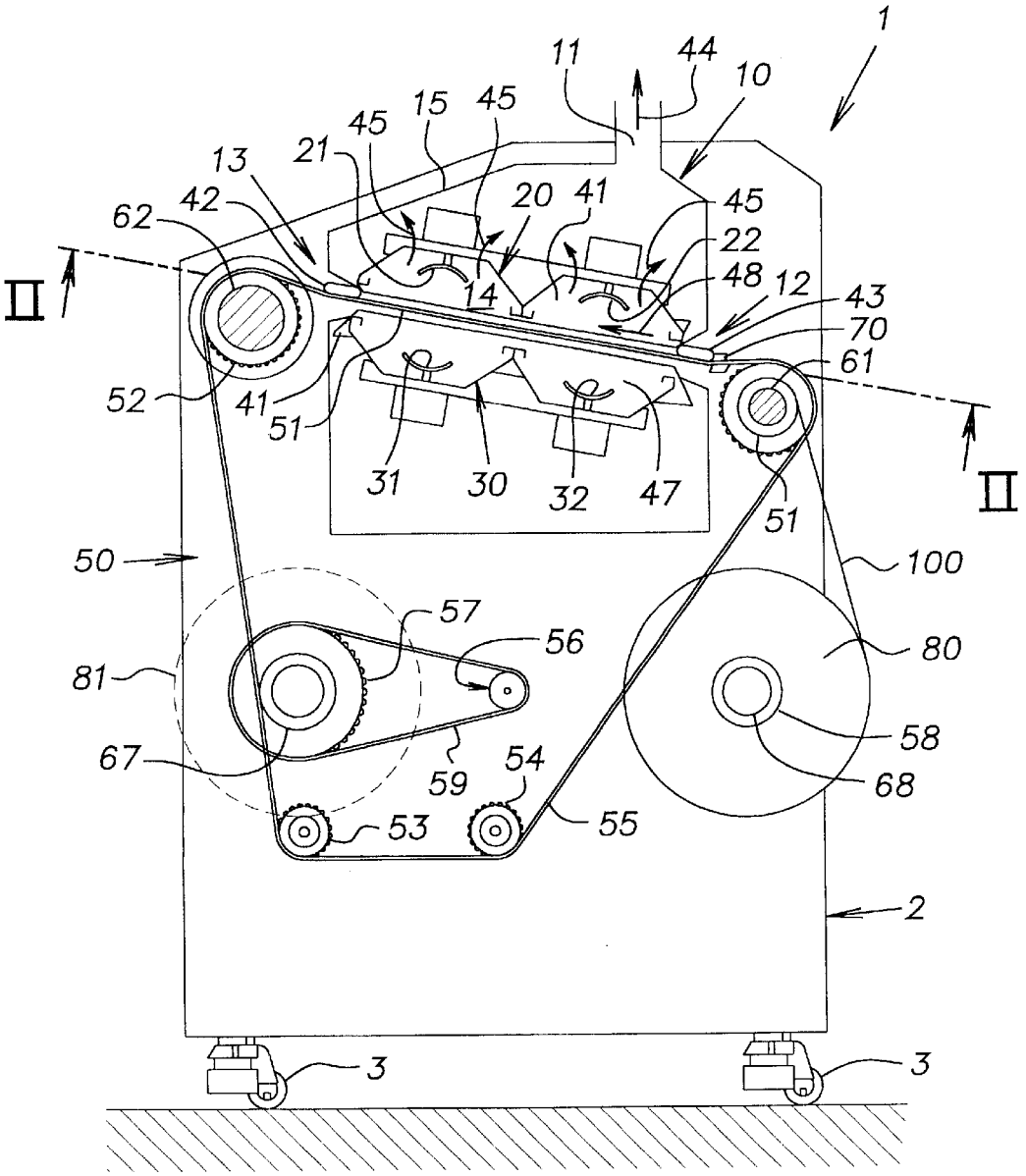
FIG. 1 is a schematic side view in cross-section, of an apparatus according to the invention.

The thermosoling apparatus 1 according to the exemplary embodiment shown in the drawings represents the presently most preferred embodiment of the invention.

The apparatus 1 has a housing structure 2 placed on wheels 3, a treatment space enclosure 10 and a transport mechanism 50.

The heating enclosure 10 is has a generally elongate shape, has heat resistant steel upper and lower wall members 15, 16 covered by an insulation layer (not shown). Along opposite sides of the enclosure 10 entry and exit passages 12, 13 in the form of slots are provided.

The transport mechanism 50 has endless circulatable chains 55 which extend through the slots 12, 13. The chains 55 pass over sprocket wheels 51–54 of which upper pairs of sprocket wheels 51, 52 are mounted rotatably and coaxially with transport rollers 61 and 62, on opposite sides of the enclosure 10. A line tangential to upper portions of both rollers 61 and 62 essentially defines a trajectory 51 through the enclosure 10 along which a web of textile to be treated can be transported through a treatment space 14 within the enclosure 10.

Above and below the trajectory 51 heating structures 20, 30 in the form of rows of infrared radiators 21, 22, 31, 32 are arranged, the rows extending in longitudinal direction of the enclosure 10, i.e. transverse to the trajectory 51. These radiators 21, 22, 31, 32 each have a reflector facing towards the trajectory 51.

The radiators are of the electrically operated dark infrared radiating type. Suitable radiators are for instance Elstein FSR and FSR/2 radiators which are commercially available. The heating structures are provided with perforations via which the area of the trajectory 51 communicates with the air discharge passage 11 as is represented by arrows 45.

Below the transport roller 61 a feeding spool holder 68 is arranged in which a spool 80 carrying a web of printed textile to be treated can be suspended rotatably. Below the transport roller 62 a collecting spool holder 67 is arranged in which a spool 81 carrying a web of printed and treated textile can be suspended rotatably. The collecting spool holder 67 is connected to a coaxially mounted drive wheel 57 that is operatively connected to another drive wheel 56 by means of a flexible endless belt 59. By means of this motor the collecting spool 81 can be rotated in order to pull a web of textile through the treatment area.

Figure 3:
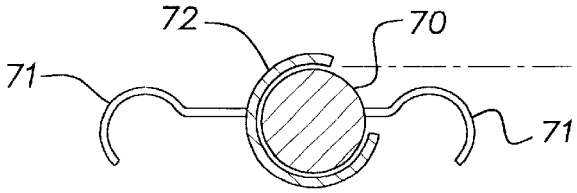
FIG. 3 is a view in cross-section of a pull-in member of the apparatus according to FIGS. 1 and 2.

The apparatus if further provided with a rod 70 (see also FIG. 3) at the ends of which hooks 71 are provided for releasably engaging the rod 70 between the chains 55 in an orientation transverse to the chains 55.

Figure 2:
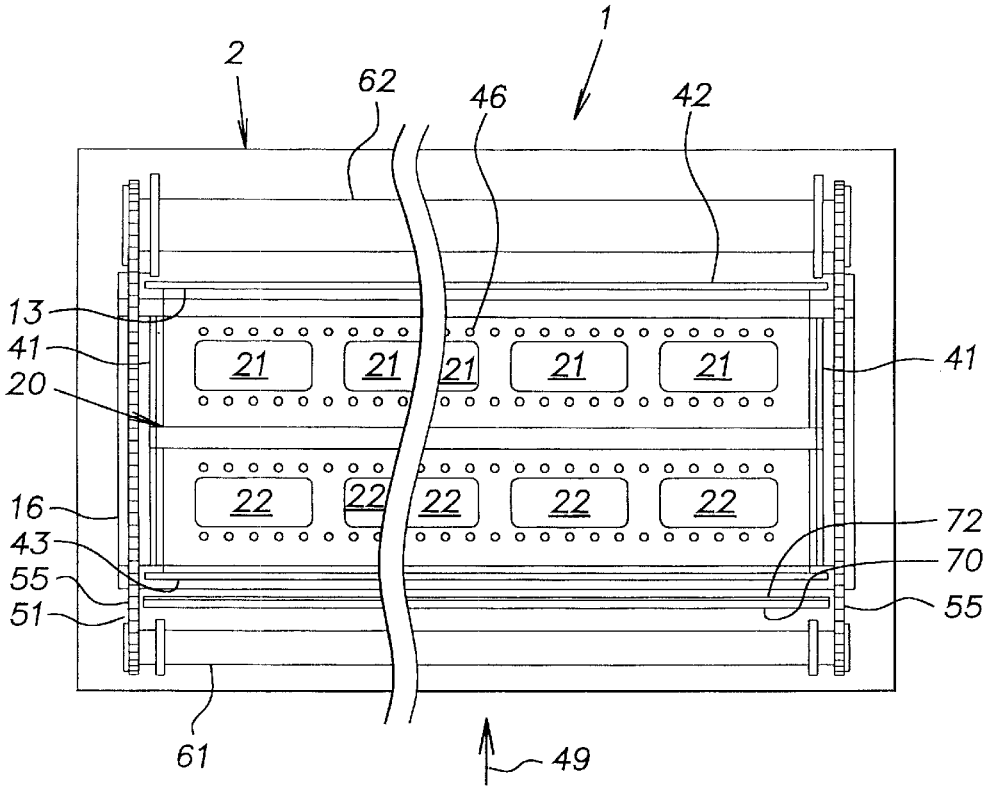
FIG. 2 is a schematic in cross-section along the line II—II in FIG. 1.

The rod 70 is removably connected at its ends to the chain 55 so that in a start position as shown in FIGS. 1 and 2, the rod 70 extends across the full width between the chains 55.

In operation, first the heating structures 20, 30 are energized to bring the treatment area 47 between the heating structures 20, 30 at operating temperature.

While the heating structures 20, 30 are warming up, a spool 80 onto which a web 100 of printed textile has been wound is placed in the spool holder 68. A free end of the web 100 is attached to the rod 70, thereby passing over the transport roller 61. To this end, a the free end of the textile web 100 is formed into a loop around the rod 70 and clamped over the rod 70 by a profile 72 having flange portions extending on opposite sides of a clamping area between the flange portions for clamping the textile web around the rod 70. The profile 72 is C-shaped, but might as well have been U-shaped, V-shaped or the like Next, the chains 55 are circulated in a sense indicated by an arrow 48 in FIG. 1 and an arrow 49 in FIG. 2, thereby pulling the textile 100 along the trajectory 51 through the enclosure 10 and over the transport roller 62 down to towards the collecting spool 81. When the rod 70 is near the collecting spool 81 the rod 70 is removed from the chains 55 and attached to the collecting spool 81. It is important that this is carried out without interrupting movement of the web in the treatment area 47, because such an interruption would cause overheating of the textile in the treatment area 47.

The collecting spool 81 is driven further by a motor (not shown) which is coupled to the drive wheels 56, 57 and the belt 59, thereby pulling the textile 100 over the transport roller 61, through the enclosure 10, over the transport roller 62 and onto the collecting spool 81. When the spool 80 is fully unwound, the trailing end of the web 100 can be attached to a rod 70 connected to the chains 55 as well to ensure that the web is tensioned in the treatment area 47 up to the passage of the trailing end thereof. The spool 81 with the thermosoled textile can then be removed and replaced by an empty one, whereas the now empty spool 80 can be replaced with a full spool with textile to be treated.

To engage the rod 70 at the leading end of a web, in this example the collecting spool 81 is provided with a slot in its axial direction in which the rod 70, and thereby the leading end of the textile 100 can engage.

Although in this preferred embodiment a rod 70 attached between the chains 55 is used to pull the leading end of a web 100 through the treatment area 47, many other members for pulling the leading end of a web through the treatment area 47 are readily conceivable, such as cords mounted between the chains and attached to the leading end of the web. Furthermore, the clamp 72 does not have to clamp the elongate member along its full length; also spaced clamping positions are possible. Other means for connecting the textile to the elongate member are also possible, such as a prefabricated loop in the leading end of the web or a strip attached to the leading end of the web.

The heating structures 20, 30 include sensors in the treatment area 47 and a control system for controlling the radiating elements 21, 22, 31, 32 to ensure the correct temperature of the web 100 is reached and not exceeded. The radiation heats the textile material of the web 100 and the dyestuffs applied thereon. This causes the dyestuffs to sublimate and to diffuse into a vapor phase and thereupon to be bonded intensely to the fibers of the textile.

The radiating elements 21, 22, 31, 32 are so-called dark infrared radiators. The use of dark red infrared radiation to heat the textile provides the advantage that dark colored portions of a printed pattern are heated to substantially the same temperature as light colored patterns. For this reason, the use of dark red infrared radiation is particularly suitable for thermofixation of printed patterns with contrasting portions.

Preferably, the wavelength of the infrared radiation is between 2 $\mu$m and 10 $\mu$m. In this wavelength range a particularly uniform heat transfer to different kinds of dyestuffs is possible, as the absorption at these wavelengths is influenced very little by the color or the tint of the dye.

Generally dark red infrared radiators do not emit a single wavelength but a range of wavelengths. To obtain an intense but uniform heating effect, a dark infrared radiator with a radiation wavelength distribution with its maximum in the range of 3 $\mu$m to 6 $\mu$m is recommended, whereby a range of 3.5 $\mu$m to 5 $\mu$m yields a particularly good result. Furthermore, the fraction of radiation by the radiators in wavelengths shorter than 2 $\mu$m should preferably be as small as possible to increase efficiency. For treating polyester fiber textile, the radiators are preferably controlled to reach a textile temperature of about 280–320° C. and more preferably about 300° C. The air temperature in the treatment space 47 will then preferably be in the range of 180° C. to 220° C. and more preferably of 195° C. to 200° C.

Natural convection causes heated air to escape via the air discharge openings 11 above the trajectory 51 of the textile web and in an upper portion of the enclosure 10 as is represented by arrow 44. This natural draft generates a pressure drop over the portion of the web in the trajectory in the treatment space 47, which in turn causes a slight flow of air through the web 100.

The spool 80 is mounted in such an orientation that in the trajectory 51, the printed face of the web 100 is facing towards the lower radiators 31, 32 and away from the side of the trajectory 51 from where the air is discharged. This causes the airflow to entrain sublimated dye vapor back to and into the textile fabric onto which it was printed, where it is bonded to the polymer material of the textile. Because the dyestuff particles are forced through the fabric, the percentage of particles that bond with the fibers is significantly increased and the efficiency of the thermosoling process is accordingly increased. Due to this effect, very little dye is lost during the thermosoling, so that the final densities of the thermosoled pattern can be very high. This in turn allows to reach desired pattern densities with small amounts of dye, which can be thermosoled so completely that washing of the textile after thermosoling can be dispensed with.

The speed of the textile 100 when passing through the enclosure 10 is dependent on the material of the fabric and the dyestuffs used, whereby a speed in the range of 0.25 to 0.75 m/min gives particularly good results.

The air speed which generates the best thermosoling efficiency can be attained by controlling the convection airflow through the fabric. This can be achieved for example by controlling the air intake or throttling the air discharge 11.

In this example, the pressure drop over the web subjected to thermosoling is obtained due to two effects. Firstly, the discharge of air from one side of the web and, secondly, natural convection in the area of the web. For the first effect the printed face of the web should face away from the side where air is discharged. For the second effect the printed face of the web should face downwards. Although already only one of these effects can bring about a noticeable difference, in particular if additional measures are taken to increase the natural draft or to force the discharge of air using a ventilator or the like, it is preferred to combine both effects as in the present example.

To increase the amount of dye being bonded to the textile, it is also advantageous that heat sources 30 are located at the side of the trajectory 51 towards which the printed face of the web 100 is facing.

The flow of air through the web 100 is further enhanced by the presence of the slots 12, 13 which also form air intake openings provided under the trajectory 51 of the web 100.

To ensure that air is taken in predominantly below the web 100, the entry and exit passages 12, 13 are each bounded at the upper side thereof by a lip 43, 42 respectively, projecting to closely adjacent the trajectory 51.

By sloping the trajectory of the web 100 within the enclosure 10 some airflow in longitudinal direction of the web is obtained which is favorable for further increasing the uniformity of the temperature of the web. The sloping angle of the trajectory is preferably between 5 and 35 degrees. The airflow can also be influenced by the suitably positioning the air intake and the air vent.

To avoid losses in pressure drop due to air flowing around lateral edges of the web 100, inner wall surface portion extending closely along,lateral sides of the trajectory 51 for essentially separating the lower side of the trajectory 51 from the upper side of the trajectory 51 when a web 100 extends along the trajectory through the treatment space 47.

The invention as shown in the preferred embodiment is specially suited for use in combination with an ink jet printing system for printing textiles. In such a system the dyestuff is applied to the surface of the textile using a ink jet printer. The printed textile is then transferred to the thermosoling apparatus according to the invention. Although in the preferred embodiment the textile is transferred batch wise, the invention is not limited to this application. The invention can also be applied in-line with a printer.

Although the invention has been described in detail with reference to a preferred embodiment, from the foregoing it will readily become apparent to those skilled in the art that many and varied changes can be made without departing from the spirit and scope of the invention. For instance, in the preferred embodiment, infrared radiation is applied to both sides of the textile; however, the invention can also be applied with application of radiation to a single side of the textile. The way the web is guided and transported through the treatment space can be carried out in completely different manners, for example by using pinching jaws gripping the leading end and transport rollers forming a nip engaging the web downstream of the treatment space.

What is claimed is:

1. An apparatus for thermosol treatment of surface printed textile, comprising:

a transport structure for transporting a web of surface printed textile through a treatment space in its longitudinal direction; and at least one heat source arranged for emitting heat in said treatment space;

an enclosure, enclosing said treatment space, said enclosure being provided with an entry passage and an exit passage, a trajectory extending from said entry passage to said exit passage; and a discharge structure for discharging air from said treatment space from above said trajectory and between said entry and said exit passages;

wherein said at least one heat source is arranged for emitting heat in said treatment space for generating a pressure drop causing a flow of air through the web for entraining sublimated ink on a lower side of said web back to said web.

2. An apparatus according to claim 1, wherein said at least one heat source is formed by at least one dark infrared radiator.

3. An apparatus according to claim 2, wherein said at least one radiator has a central wavelength range portion in a range between 2 $\mu$m and 10 $\mu$m.

4. An apparatus according to claim 2, wherein said at least one radiator is adapted for emitting at least 80% of all energy emitted by said radiator in a wavelength range of 2 $\mu$m to 10 $\mu$m.

5. An apparatus according to claim 2, wherein said at least one radiator is adapted for emitting radiation over a range having a peak value between 3.5 $\mu$m and 5 $\mu$m.

6. An apparatus according to claim 2, wherein said at least one radiator is adapted for emitting at least 90% of all energy emitted by said radiator in a wavelength range of 2 $\mu$m to 10 $\mu$m.

7. An apparatus according to claim 1, further including an air intake opening for taking in air into a portion of said space within said enclosure on a first side of said trajectory.

8. An apparatus according to claim 7, wherein said air intake opening is formed by at least one of said entry and said exit passages.

9. An apparatus according to claim 7, wherein a second side of said trajectory is opposite said first side of said trajectory, and wherein at least one of said entry and said exit passages is bounded at said second side by a lip projecting at least to closely adjacent said trajectory.

10. An apparatus according to claim 1, wherein said trajectory in said treatment space extends at a sloping angle from a bottom end to a topmost end.

11. An apparatus according to claim 1, wherein said transport structure comprises a pair of endless, circulatable conveyor members having mutually parallel portions spaced apart on opposite sides of said trajectory, and a pull-in member releasably connectable between said two conveyor members for pulling a leading end portion of textile along said trajectory.

12. An apparatus according to claim 11, further comprising a clamp for releasably clamping a leading end portion of said web to be treated to said pull-in member.

13. An apparatus according to claim 11, further comprising a collecting spool with engaging means for engaging said pull-in member.

14. An apparatus according to claim 1, wherein said trajectory has a lower side and an upper side, and wherein said enclosure includes inner wall surface portion extending closely along lateral sides of said trajectory for essentially separating said lower side of said trajectory from said upper side of said trajectory when a web extends along said trajectory through said treatment space.

15. A method for thermosol treatment of surface printed textiles, including the steps of:

providing a web of surface printed textile carrying a surface print on a printed face thereof, said printed face facing to a first side of said web;

transporting said web along a trajectory extending through a treatment space, causing said web to enter said treatment space, to pass through said treatment space and to exit said treatment space;

heating at least a portion of said web in said treatment space; and generating a pressure drop over said web from said first side of said web to an opposite, second side of said web for entraining sublimated ink on said first side of said web back to said web.

16. A method according to claim 15, wherein said printed face is facing downwards while said web is transported through said treatment space.

17. A method according to claim 15, wherein said transporting of said web along said trajectory is from an entry passage to an exit passage in an orientation in which said printed face is facing towards a first side of said trajectory, said treatment space being enclosed, and wherein air is discharged from said treatment area on a second side of said trajectory opposite said first side of said trajectory and between said entry and said exit passages.

18. A method according to claim 17, wherein air is introduced into said treatment space on said first side of said trajectory for replacing air discharged from said chamber.

19. A method according to claim 17, wherein said air is introduced via at least one of said entry and said exit passages.

20. A method according to claim 17, wherein at least one of said entry and said exit passages is sealed against said web at said second side of said trajectory.

21. A method according to claim 15, wherein said heating is carried out by subjecting said web to dark infrared radiation.

22. A method according to claim 15, further comprising the steps of releasably clamping a leading end portion of said web to a pull-in member and passing said pull-in member through said treatment space along said trajectory.

23. A method according to claim 22, further comprising the step of subsequently engaging said pull-in member to a collecting spool.

24. A method according to claim 15, wherein said web is transported in longitudinal direction through said treatment space at a sloping angle from a bottom end to a topmost end.

25. A method according to claim 24, wherein said sloping angle is between 5 to 35 degrees.

26. A method according to claim 15, wherein said treatment space is maintained enclosed, said enclosure extending closely along side edges of said web for substantially separating an upper portion of said treatment space from a lower portion of said treatment space.

27. A method according to claim 15, wherein said heating of at least a portion of said web in said treatment space is carried out by emitting heat in said treatment space on at least said first side of said trajectory.

* * * * *